US005695279A

United States Patent [19]

Sonnleitner et al.

[11] Patent Number: 5,695,279

[45] Date of Patent: Dec. 9, 1997

[54] LOW VOLTAGE LIGHT CONSTRUCTION

[76] Inventors: Ferdinand Sonnleitner; Susan Elizabeth Zimmer, both of Josef-Neuberger-Strasse 8, D40625 Duesseldorf, Germany

[21] Appl. No.: 494,713

[22] Filed: Jun. 26, 1995

Related U.S. Application Data

[63] Continuation of Ser. No. 238,760, May 5, 1994, abandoned.

[30] Foreign Application Priority Data

May 14, 1993 [DE] Germany ..... 9307373 U

[51] Int. Cl.[6] ..... F21S 1/02

[52] U.S. Cl. ..... 362/419; 362/250; 362/285; 362/413

[58] Field of Search ..... 362/226, 249, 362/250, 285, 381, 410, 411, 413, 419

[56] References Cited

U.S. PATENT DOCUMENTS

| | | | |
|---|---|---|---|
| 3,748,463 | 7/1973 | Trassinelli | 362/411 |
| 4,525,773 | 6/1985 | Hesse et al. | 362/413 |
| 4,802,074 | 1/1989 | Puschkazski | 368/419 |
| 4,858,092 | 8/1989 | Lu | 362/413 |
| 5,034,865 | 7/1991 | Sonneman | 362/410 |
| 5,049,081 | 9/1991 | Ribitsch et al. | 362/250 |
| 5,077,647 | 12/1991 | Treichl | 362/391 |
| 5,091,834 | 2/1992 | Kao et al. | 362/410 |

FOREIGN PATENT DOCUMENTS 3620920 1/1988 Germany .

OTHER PUBLICATIONS

"Grafik Design" Catalog, 1988.
"Solken–Lenchten" Catalog, no date given.
"Optelma AG, Innenbeleuchtung", 1993.

*Primary Examiner*—Stephen F. Husar
*Attorney, Agent, or Firm*—Troutman Sanders LLP

[57] ABSTRACT

A low-voltage light construction created by tube construction elements made up of male and female embodiments of electrically insulated metal tubes or metal rods and metal tubes. The male embodiment is connected to a low-voltage energy source by two circuit extensions, whereas one extension is electrically connected to the inner rod and the other extension is electrically connected to the outer tube. The construction provides simple assembly possibilities and enables numerous arrangements using a variable amount of connecting tube elements which are pushed together by manual pressure. The tube sections are set symmetrically to the illuminants and can be rotated around their axes. The illuminants are set in two pin circuits, which are connected to a pair of electrically conducting bars. These are held to the metal tube elements by round headed nuts. This makes it possible to rotate the illuminants on two additional axes. Each illuminant can thus be rotated independently around three axes, providing multi-directional lighting capability depending on the user's preference.

13 Claims, 5 Drawing Sheets

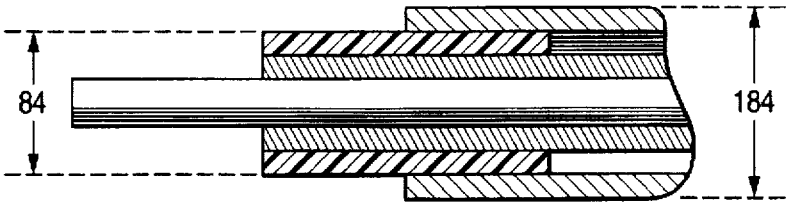
FIG. 5
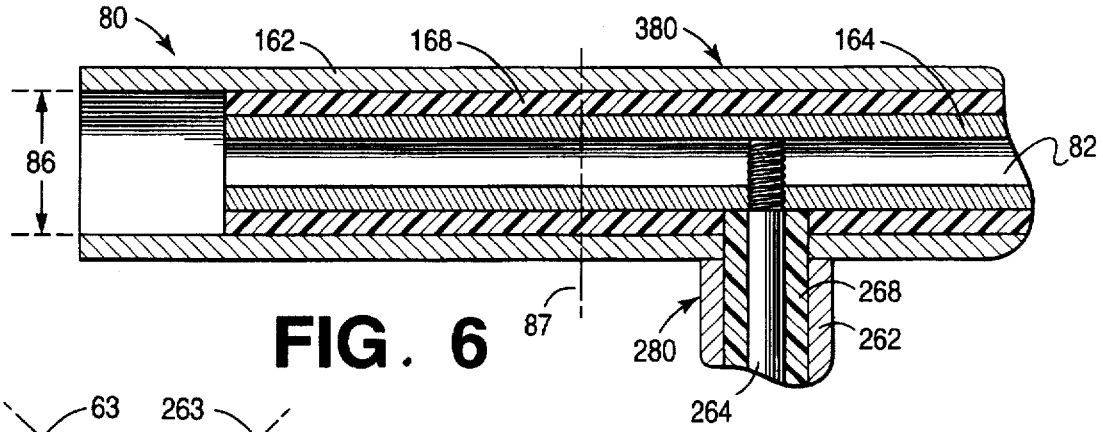
FIG. 6
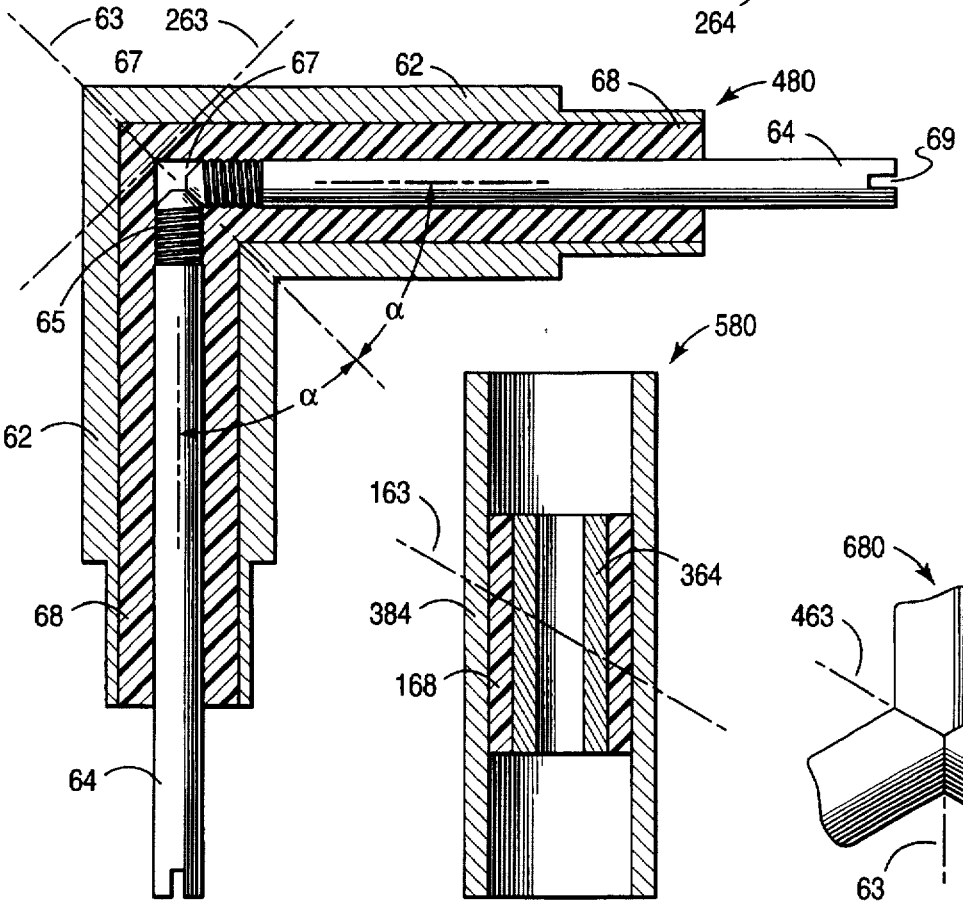
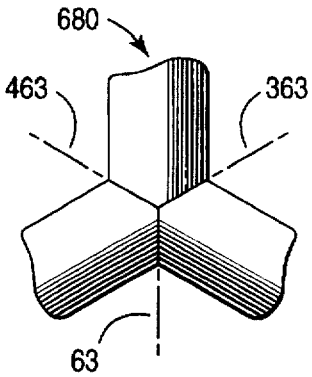
FIG. 7 FIG. 8 FIG. 9

LOW VOLTAGE LIGHT CONSTRUCTION

This is a continuation of application Ser. No. 08/238,760 filed on May 5, 1994, now abandoned.

BACKGROUND OF THE INVENTION

1. Field of the Invention

The invention relates to a low-voltage light construction with two electric circuits connected to a low-voltage energy source leading to at least one pair of parallel bars; these conduct electricity to at least one illuminant with a low-voltage bulb and are held to a metal tube. The illuminant can be rotated by an axis around the bars and the bars can be rotated by an axis around the metal tube which is generally positioned vertically in relation to the axes of the bars.

2. Description of the Prior Art

A similar arrangement is known under DE 36 20 920 C2. Also known are low-voltage constructions which have two circuits isolated from each other and are mounted e.g. to a ceiling. Between these there are two further circuits to which illuminants are electrically connected to one of both circuits mechanically or electrically (See catalog titled "Grafik Design, Konzeption: R. Pieconka—Iserlohn, Dez. 1988"). A catalog by the firm "Sölken-Leuchten" shows a low-voltage current track system designed for halogen lamps which enables two tracks to be attached at variable lengths. The track system is based on a grid of tubes each at a length of around one meter which can be shortened individually with a saw. With the use of variating angular connecting pieces angle constructions between 90° and 45° or S-curves are possible. For vertical constructions other variating angular connecting pieces or a connection with a 90° angle are available. The track system is based on two current circuits which are mounted separately side by side at a short distance to each other. Corresponding holder elements which hang from the ceiling hold the tracks at their relative distance. The system also has socket joints and distancing bolts for the final assemblage as well as cross joints with which two crossing track pairs can be connected to each other, either mechanically or electrically.

The illuminants, which are either a single bar in which two pole circuits are enclosed or two single bars which each form separate poles. These run from the two circuits which create current tracks.

The Swiss firm "Optelma AG" in CH-4537 Wiedlisbach has a catalog called "Innenbeleuchtung" in which under the brand name "XEN" the use of a conducting system is described. A hollow piece of metal tube holds a coaxial insulated conductor. A number of such metal tube pieces can be screwed to each other with the help of simple joints and/or angle elements, or with T-joints, which either enable branching or the attachment of an illuminant element, which itself has sockets and connecting tubes.

By using especially designed joints a current connection can be realized. These joints can also be used for fixtures that can be hanged from the ceiling.

The disadvantage of this system is that the construction is very complex. The screwing process also hinders a variation of the tubes axes after the system is assembled, which limits the possibilities of adjusting the lamp elements. Due to the construction the metal tube pieces and the joints cannot have a unified outer diameter. This is an aesthetic disadvantage.

The disadvantage of DE 36 209 20 C2 is that the tracks conducting current each have separate circuits which impairs the flexibility, because these circuits, which are assembled at a fixed level which leads through both circuit axes, complicates the assemblage in corners and edges. In addition, setting the illuminants can only be uncomplicated if these are set vertically to the level of both track axes or are mounted at an axis which is within this level. Thus the possibilities of rotating the illuminants are limited.

Setting two different currents often involves additional complicated assembly equipment to realize all illuminating possibilities.

SUMMARY OF THE INVENTION

The invention's purpose is to improve contemporary low-voltage light constructions so that the disadvantages no longer exist The solution is that bars extend from lateral electrical conducting extensions of a tube piece which is made up of an outer metal tube and an electrically insulated metal rod, whereas one extension is electrically connected to the outer tube and the other extension is electrically connected to the inner rod.

This arrangement creates a low-voltage light construction that looks more aesthetic, because instead of two tracks, only one tube construction is needed to hold and conduct electricity to the illuminants. This arrangement also makes it possible to use assembly pieces that are much simpler to enable any arrangement using a various amount of elements.

In addition, the arrangement enables a rotation of the illuminant not only around one or two axes, but even around a third axis, which increases the multiplicity of illumnation possibilities dramatically.

A further improvement of the invention is that the extension is made of a threaded pin, which is screwed into a threaded hole of the outer tube. Accordingly the other extension can also be a threaded hole that itself is formed by an insulated piece between the metal tube as a passage threaded hole and/or by a threaded hole (preferably a threaded hole with a blind end) in the inner metal rod. These constructions are especially simple to realize and are especially flexible.

The threaded pins can be enclosed in electrically insulated casings or coverings which on the one side form a stop on the outer/inner metal tube and on the other side form a stop for the open end of the threaded pin into which the bars are pinned through the holes of their ends and which are themselves held by nuts, for example rounded head nuts. This makes it possible to rotate the illuminants on two axes.

The outer tube forms either on one or on both ends an outer shoulder to accommodate a connecting section that is manually pressed into place. The result is an inexpensive push together assembly system, but in addition a further possibility of rotating the illuminant in yet another direction around the outer tube axis.

The outer tube can form an inner shoulder on one or both ends to accommodate another section that is manually pressed into place. It is especially convenient when the inner rod extends beyond the outer tube on one or both ends, because this makes an especially stable push together assemblage. However, the outer tube can also extend beyond the inner tube on one or both ends, which is an especially good advantage for a corresponding push together assembly.

The connecting section can show the same outer diameter as the outer tube and also an inner diameter at the end that enables it to be pushed onto the shoulder by manual pressure. The connecting tube shows an inner metal tube with an axial hole into which the inner rod can be inserted by which creating touch contact. The connecting section can be connected by a holder such as a chain, pole or clamp that is preferably set in the center.

The complete tube section can be set symmetrically to the illuminant as well as to the connecting section, each in relation to its center, which simplifies the use. The holder can have a similar construction, but a smaller outer diameter than the complete tube section or the connecting section that can make the assembly between both tubes simpler.

The holder can be made of an outer tube inside of which is a rod which is encompassed by an insulating covering or and insulating tube, whereby the rod is screwed into a threaded hole formed by the insulating tube or inner metal tube or metal rod of either the complete tube section or the connecting section. The outer metal tube presents a female coaxial fitting into which at least the insulation of the threaded rod fits.

BRIEF DESCRIPTION OF THE DRAWINGS

The invention will be explained further by applicable examples that are shown in following drawings. These show:

FIG. 5. Another type of the tube element shown in FIG. 4.

FIG. 6. A push-on element that fits to FIG. 5 and FIG. 4 that can be used as a connecting element and a holder.

FIG. 7. An angle element

FIG. 8. A connecting element that fits to FIG. 7.

FIG. 9. An arrangement of a three-sided connecting element.

DETAILED DESCRIPTION OF THE PREFERRED EMBODIMENT

Figure 1:
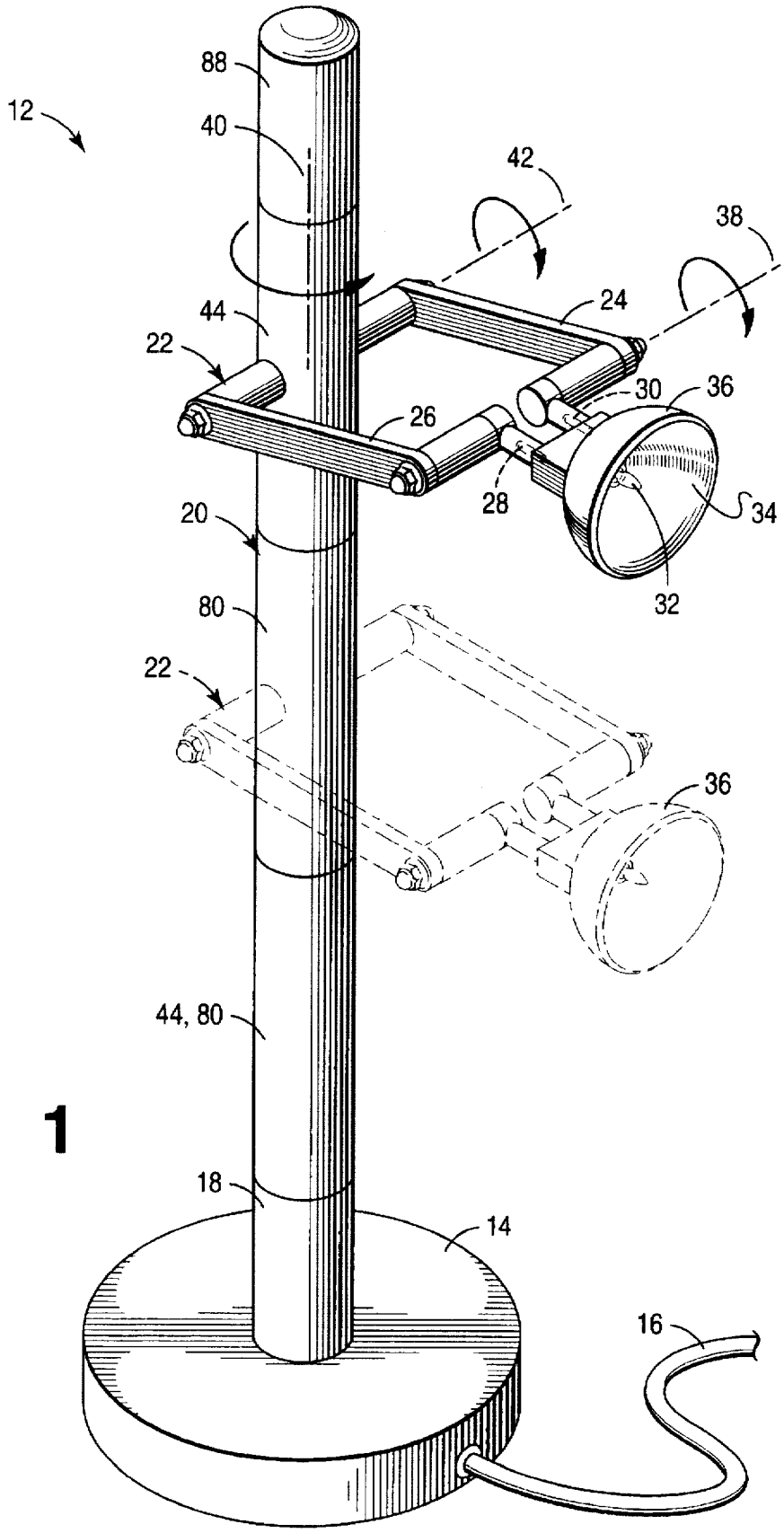
FIG. 1. A low-voltage light construction as a standard lamp made with a number of exchangeable elements, whereby the standard lamp may have one or more illuminants.

FIG. 1 shows a low-voltage light construction in the form of a standard lamp 12 made of a base 14 which by the use of a wire 16 can be plugged into a wall socket and within which is a low-voltage transformer which, because of its weight gives the standard lamp the needed stability. Arising from the base 14 is a stand 20 that is connected to an illuminant 36 near its upper end by two electrically conducting insulated bars 24, 26, whereby the illuminant 36 can be the customary form, i.e., that two pin circuits 28, 30 extend away from the bulb and which can be pinned onto for example bars 24, 26 and by doing so the glow thread of the halogen lamp 32, which can be encompassed in a reflector mirror 34, can be electrically connected with the bars. This kind of illuminant 36 can be for example rotated around an axis 38 and by doing so a bundled ray of the illuminant 36 can be directed at an object. The bars or wires 24, 26 of contemporary lighting fixtures are installed firmly, that is they can create the light stand 20 and thus the setting of the illuminant is limited to the rotation around axis 38.

With the form shown in FIG. 1 the bars 24, 26 are attached to the stand 20, in a way that has yet to be described, which enable a further rotation, i.e. the rotation of the bars 24, 26 around axis 42 which is directed vertically to the stand axis 40, but parallel to axis 38. By this rotation the illuminant 36 can be directed farther away or closer to an object depending on the length of the bars 24, 26 while the rotation around axis 38 can cause a change of direction. The length of the bars 24, 26 can additionally be modified by the use of a telescoping device which would make the radius of each illuminant variable.

Figure 3:
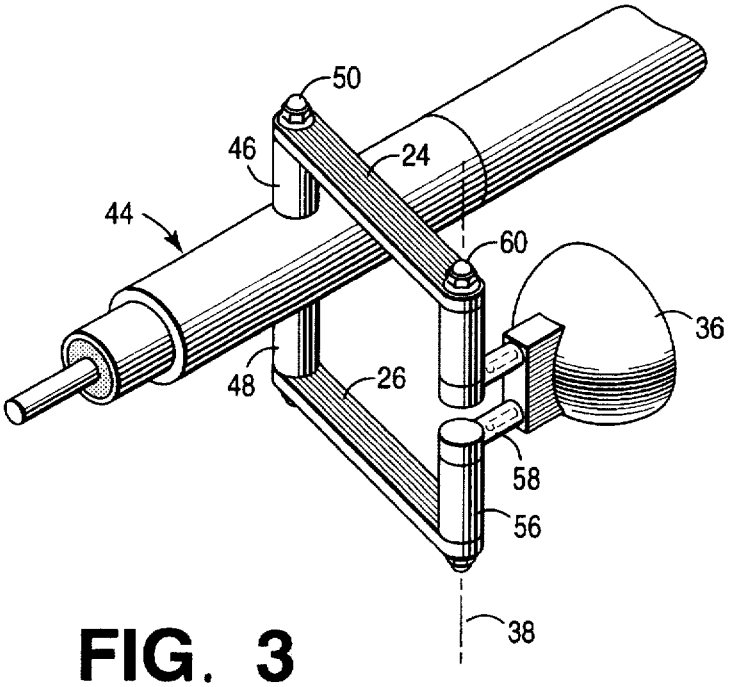
FIG. 3. A metal tube element shown from perspective, which has a lamp head attached to it.

In FIG. 3 the illuminant 36 can again be seen with an attachment by two bars 24, 26 to a holder, in this case to a rotating tube piece 44. Both bars 24, 26 have threaded holes at the end near the tube piece 44 through which e.g. a threaded rod or bolts 46 and 48 can be fitted and set through the threaded holes of 24 and 26 e.g. by screwing a round head nut 50, which pins the bars 24 and 26 between itself and a counter-nut on the opposite side, that is not visible in FIG. 3. In addition, there could also be a distancing piece, a thicker bolt end or something similar, which could form the counter-holder. On the other end of the bars 24, 26 vertical elements 56 are connected to the bars 24, 26. This is possible by an axial threaded hole in the tube 24 or 26 in which a threaded bolt can be screwed into the distancing piece 56. Extending from the distancing piece 56 is a circuit piece 58 into which the pins of the illuminant 36 can be set. From an aesthetic viewpoint, but also for fastening reasons, a rounded heading arrangement like the rounded head nut 60 can be used here. By slightly loosening this rounded head nut 60 it would be possible to make the circuit piece 58 be able to turn from the distancing piece 56 around the axis 38, as already described in FIG. 1. By tightening the rounded head nut 60 the turning ability could be halted or made more difficult so that the illuminant 36 can be adjusted in various ways but could also be fixed in the adjusted position.

Figure 4:
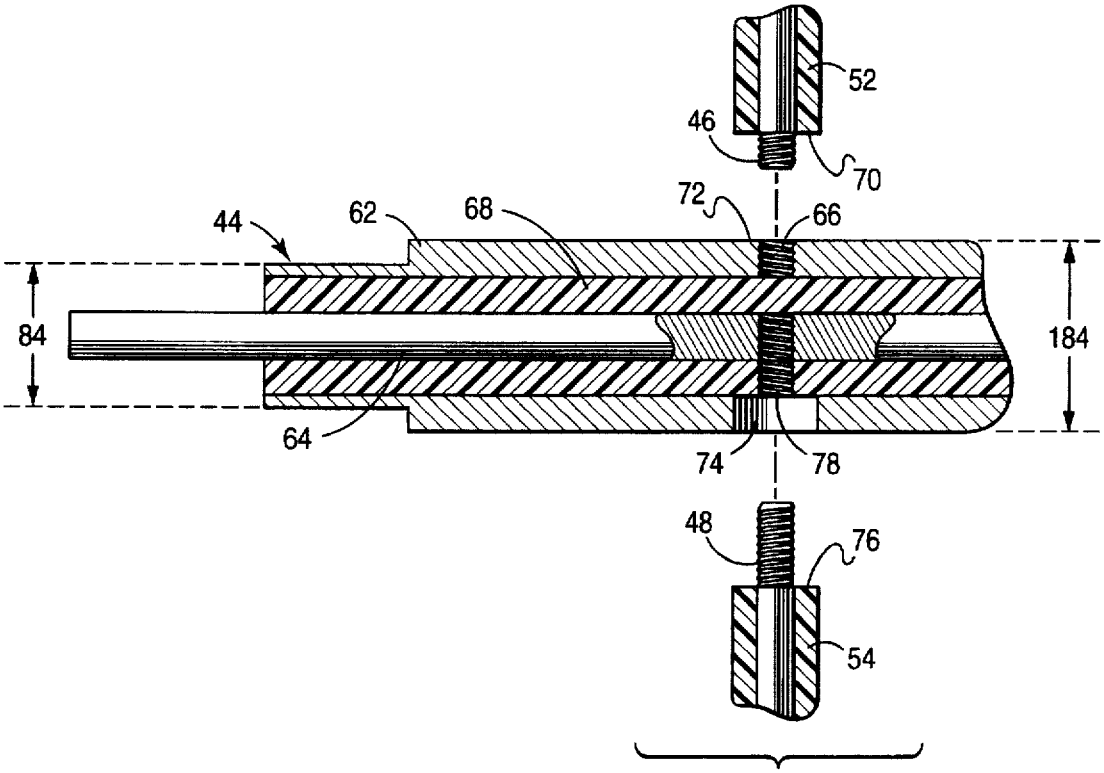
FIG. 4. A sectional view through a tube element with one type of illuminant attachment.

FIG. 4 shows how the threaded rods 46/48 could be fastened to the tube piece 44.

As is shown in FIG. 4 the tube piece 44 is made of two coaxial metal tubes 62, 64 which are electrically insulated from each other, whereby the metal tube 64 according to FIG. 4 is solid, so it is a metal rod. In FIG. 6 it actually has a tube form, that is it is hollow. The threaded rod 46 is electrically connected to the outer metal tube 62, for example in a way that this outer metal tube 62 shows a threaded hole 66 into which the end of the threaded rod 46 can be screwed into, over which is a covering or an insulation 52. This way the threaded rod 46 extends just up to the insulation 68 that is set between both tubes 64, 62 and electrically insulates these tubes from each other. In order to prevent the end of the threaded rod 46 to be screwed in too deeply and thus advance too far into the metal tube 64, either the insulating material 68 can be strong enough or the covering or insulation 52 surrounding the threaded rod 46 is formed as such that its shoulder 70 lies on the outer surface 72 of the metal tube 62 and in this way prevents the threaded rod 46 from being screwed in too deeply.

Seen from a coaxial view, on the counter-side of the tube is an opening 74, which is bigger than the outer diameter of the threaded rod 48 so that there is not any contact between the threaded rod 48 and the metal of the tube 62. Thus an electric connection cannot be made. Suitably the opening 74 has a diameter large enough to hold the insulation or the insulating distancing piece 54 so that this can then be set with its shoulder 76 onto the insulation 68 or into the inner tube 64 if the end of the threaded rod 48 is screwed into a corresponding threaded hole 78 that can either be placed only in the insulation 68 or only in the inner tube 64 or even in both. This placement enables the inner tube 64 to be electrically or mechanically connected to the threaded rod 48 while at the same time the outer tube 62 is mechanically or electrically connected to the threaded rod 46. If one pole of the electrical supply is conducted to the inner tube 64 and the other pole is conducted to the outer tube 62 both bars 24 and 26 are supplied with electrical current that the two of them can supply the illuminant 36 with electricity.

The tube piece 44 shown in FIG. 4 can be long enough to create the stand 20 of the standard lamp 12 shown in FIG. 1 so that only the base 14 must have a contrivance that takes up the end of the tube shown on the left of FIG. 4.

Alternatively the stand 20 can be made of a number of parts, e.g. a piece 44, as shown in FIG. 4 or a further piece 80 as shown in FIG. 6, left side. The lighting fixture can also hold a number of halogen lamps as shown by the dotted lines of FIG. 1. The tubing shown in FIG. 6 also has an outer metal tubing 162 and an inner metal tubing 164 that are insulated by an insulation 168. The end of the tubing piece 80 is formed as such that the outer metal tubing 162 extends beyond the inner metal tubing 164 (also beyond the insulation 168) and thus creates the possibility to clutch the end of the tubing shown on the left of FIG. 4 by plugging the protruding end of the inner metal tube 64 of the outer metal tube 62 into the hollow area 82 of the metal tube 164. The outer circumference of the outer metal tube 62 shown in FIG. 4 has at its end the circumference 84 so that it can fit into the inner diameter 86 of the outer metal tube 162 shown in FIG. 6, preferably with a certain mount of a clamping effect so that the result is an electrical or mechanical glide-one or press-on connection that has sufficient stabality. If the left part of FIG. 6 shown from line 87 on were shown axial-symmetrically, that is if the right end had a similar construction as the left end of FIG. 6, the right end of the tube 80 shown in FIG. 6 could again take up a tube as in FIG. 4. As an alternative, of course, the construction shown right from line 86 could form a similar construction as the left side of FIG. 4 shows. This way it would be possible to connect a number of tubes together, thus making a standard lamp stand 20 as shown in FIG. 1. The upper end of the stand 20 can have a top piece 88, which is made like the end of FIG. 6, but with a blind function.

Figure 2:
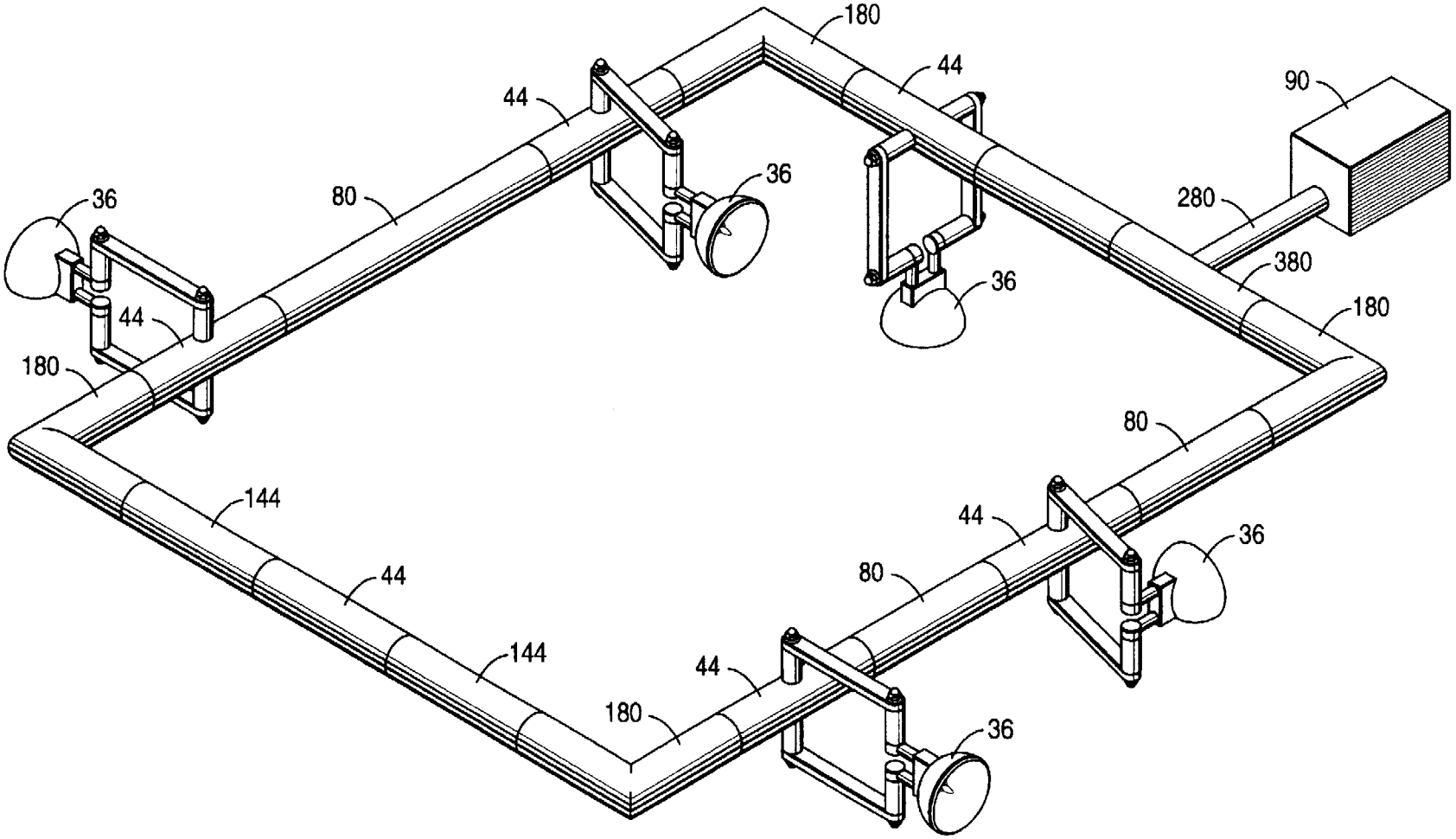
FIG. 2. An example of a low-voltage light construction, which could be hung from the ceiling and which has a number of illuminants for illuminating a room.

By the different forms of the tubes 44 and 80 it becomes possible to make a low-voltage light construction as shown in FIG. 2. Here, for example, on one side the are three tube pieces 44 as shown in FIG. 4, which each has an illuminant attached that are each connected to tube pieces 80 constructed as shown on the left part of FIG. 6. These tube pieces 44 or 80 could then be hooked to the ceiling with a clamp or a holding device, the manner of which will here not be discussed in detail. At the angled areas, curved coaxial tube pieces 180 can be used. It is also possible to use tube pieces such as in FIG. 4, which do not have attachments for illuminants and which are only meant as connecting pieces for tube constructions shown in FIG. 6. These may have the determining number 144.

At any end of a number of tube pieces there could then be a fitting socket to a transformer 90, which could for example have a customary coaxial plug that can be fitted into a clutch construction, as shown on the left side of FIG. 6. Alternatively, however, the could also be a clutch construction as shown on the right side of FIG. 6, see determining number 380, so that from the tube piece 380 there would be a connecting tube 280 which could be meant as an energy supply, but at the same time could be used as a hanging device, if this should seem suitable.

The construction is made in a way that the outer tube 162 can be in a mechanical or electrical connection with the outer tube 262 of the tube piece 280, whereby the insulation 268 goes far enough into the inside that there can be no conduction between the inner tube 264 and the outer tube 162. Moreover, the inner tube 264 of the tube piece 280 is electrically, and in some cases mechanically, connected to the inner tubing 164, for example screwed on in a similar fashion as explained in FIG. 4. The result is a mechanical and an electrical connection between the tube 264 and the tube 164 on the one hand and the tubes 262 and 162 on the other hand. The tube piece 280 could then be connected to a transformer 90 or with a similar energy source as shown in FIG. 2.

For aesthetic reasons and for the sake of better maintenance, the outer diameters of the pushed together tube pieces 80, 180, 44, etc should be the same. Only the socket connecting tube 280 should show a smaller diameter. To be able to get the same diameters, the connecting areas as shown in FIG. 4 and in FIG. 5 have a reduced diameter 84 that go into a diameter 184 that is larger and has the same outer diameter as the outer tube 80 or 380.

To achieve a reduction of the outer diameter, the tube piece of the outer diameter 184 could be turned on a lathe. It would, however, be easier to use a tube piece as shown in FIG. 5, which has an outer diameter 184. The outer diameter 84 is made by a second tube piece that is pushed into the tube with the outer diameter 184. This second tube 84 could either extend throughout the whole length of the tube or simply have the length of the end area.

FIG. 7 shows the construction of a piece as in FIG. 4 (or alternatively as in FIG. 6), the end of which is cut at an angle, for example at an angle of $\alpha$, which could be 45° but also any other adequate angle, and then be connected to a further angled tube, preferably with the same angle $\alpha$. Thus both cut sections can be fitted to each other so that the outer metal tubes 62 could be soldered or welded. After soldering or welding the result is an angle piece which encloses an angle of $2\alpha$, whereby $2\alpha$ could for example be 90° if a right angle is needed, but could also be an angle of 45°, 60°, 120°, 130° or 145° or any other angle that is required depending on the construction specifications. Whereas the maximal angle is 180°, the minimal angle is only limited to an angle that obtains a sufficiently stable connection between the two metal tubes 62.

Because of the coaxial construction, the result of putting both metal tubes 62 together along the cut angle 63 is that the insulation areas 68 are automatically put together as well, provided that both sections have the same diagonal. This is also the case with the inner tubes 64. It is possible to let the inner metal tubes extend out a bit so that when put together and both outer tubes 62 are soldered or welded, a pressure contact is achieved between the inner tubes. The result would be a contacting connection between these two tubes as well without having to specifically solder the inner area.

Alternatively each inner metal tube could have an outer thread at least at the end showing towards the cut angle 63, see determining number 65, with which it could be insulated on the inside of the outer tube, whereby the inside of the insulation 68 could be also be threaded. By turning the inner metal tube, an axial shift is possible in relation to the insulation. It can the be turned with a tool on the other end of the inner metal tube 64 far enough so that its tip 67 can be pressed against the corresponding tip of the other inner metal tube and thus creating an electrical connection. For turning purposes, the opposite end 69 of the inner metal tube 64 could have a cavity 69 that would for example make the use of a screwdriver an effective method.

Pushed together onto the angle piece as in FIG. 7 could be a connecting piece as in FIG. 8, onto which could again be manually pressed into an angle piece according to FIG. 7 so that a circular or any other geometrical form could be designed by pushing a number of pieces such as FIG. 7 and FIG. 8 together.

Naturally, the mode of construction as seen in FIG. 7 could be used for a piece as shown in FIG. 8; that is a connecting piece according to FIG. 8 could be cut diagonally, for example along the section 163, so that the inner tube 364 has an outer thread in the area of the sectional cut 163, similar to the threaded piece 65 on FIG. 7, which brings the tube 364 into pressure contact with an additional corresponding tube of an angled set section piece. In order to be able to rotate the inner tube 364, which is hidden inside the outer tube 384, the end of the tube that is at the further side of the sectional cut 163 could have e.g. a cavity which could be handled by e.g. a screwdriver, so as to be able to rotate the tube 364.

Principally, it is possible to cut both connection tube ends of FIG. 7 along the angled edge 263 so that another sectional plane is made onto which a further tube piece could be connected as in FIG. 9.

In order to realize a symmetrical arrangement, the angle line 263 shown in FIG. 9 could be bent with the result of the sectional planes 363, 463 which, together with e.g. the sectional plane 63, are each 180° apart.

Figure 10:
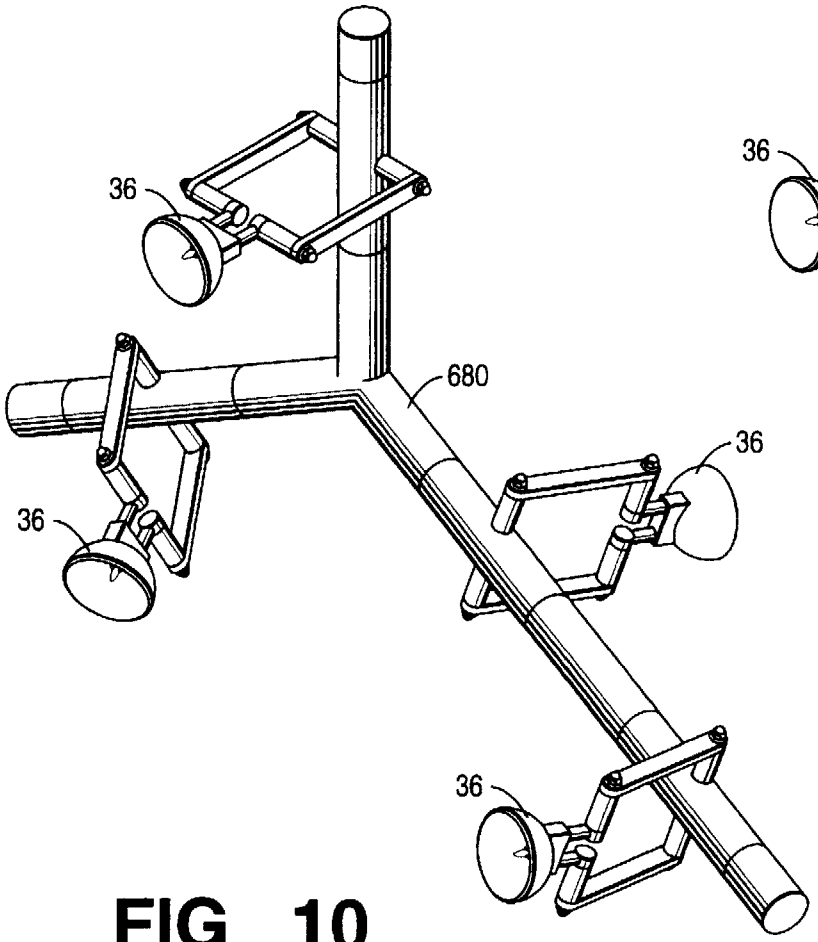
FIG. 10. An example of the use of a three-sided connecting element shown in FIG. 9.

This way a construction shown in FIG. 10 is possible, that is an arrangement of three stands at an angle of 120° to each other, to each of which illuminants can be attached. The whole construction can then be hooked to a ceiling, for example.

A finished angle element could also be made by welding two, three or more metal tubes together for example in a star form, so that the hollow inner spaces meet at the corner or star points. Subsequently hollow insulating tubes, which have an inner thread, are pushed into hollow metal tubes and are then either clamp pressed or glued into the interior of the metal tubes, so that they are stable. Subsequently, the inner conductors, such as threaded rods, could be screwed into the hollow insulating tubes so far that they meet at the corner or star points and create electrical contact.

Figure 11:
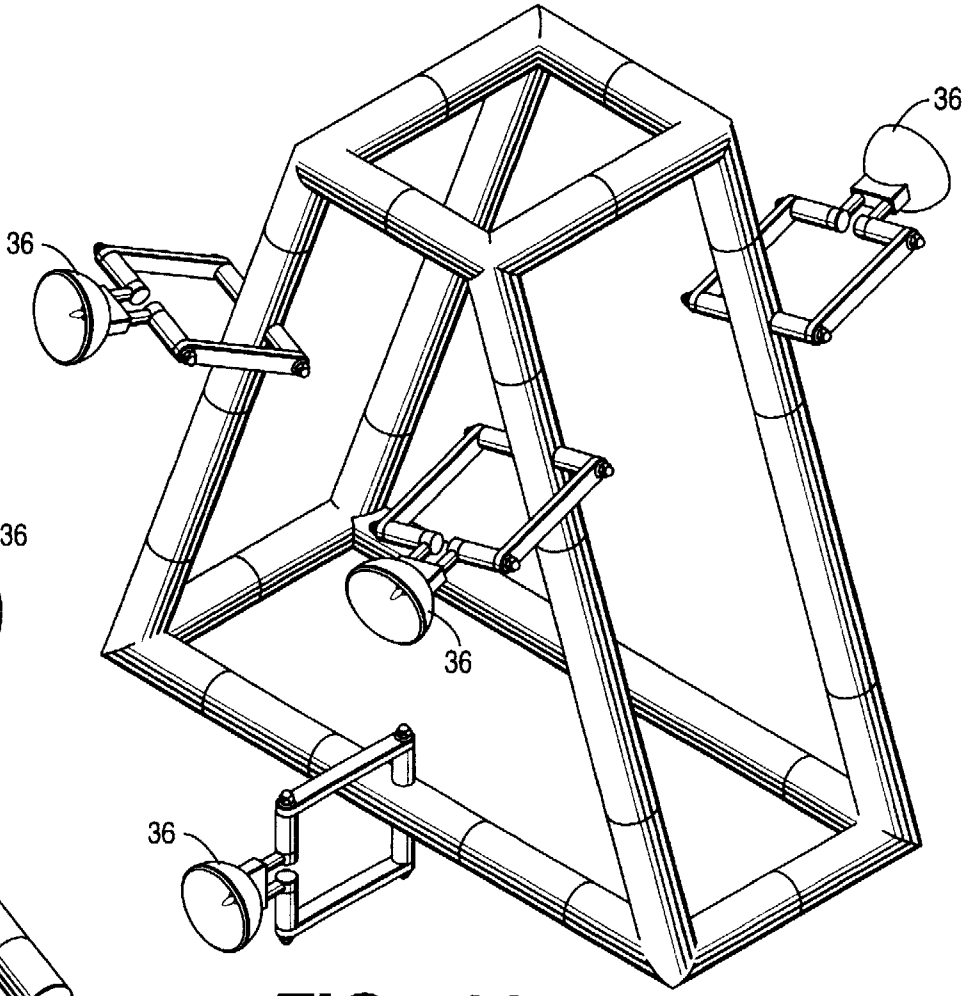
FIG. 11. An arrangement of a different example of the use of three-sided connecting elements.

Alternatively, however, a connecting tube could be attached to the area of connection 63 as was described in detail in FIG. 6 with 280. This way geometrical constructions are possible such as shown in FIG. 11, in which a four-sided pyramid is shown. The corners have three tubes running together, whereas two of the tubes could be formed as shown in FIG. 7 and then arranged with a further tube that is vertically set like the tube 280 in FIG. 5.

As can be seen, the inventive construction is remarkably flexible and with the help of relatively simple hand-crafted steps, such as welding and screwing the inner tubes, lamp constructions of various forms and sizes can be fabricated without a great amount of separate pieces and complicated arrangements that are found in contemporary lighting technology.

We claim:

1. A low-voltage lighting assembly powered by a low-voltage power supply providing an illuminant with various illumination positions, said illuminant having a first contact terminal and a second contact terminal, said light assembly comprising:

a plurality of cylindrical members joined end to end in axial alignment;

said cylindrical members having a conductive surface;

a current carrier enclosed within said cylindrical members for carrying an electrical current, an insulation layer for insulating said current carrier from said conductive surface of said cylindrical members;

a rotary joint defined between adjacent cylindrical members providing said adjacent cylindrical members with rotational movement around a central axis;

a first electrical extension termination port formed within said conductive surface and said insulation layer of certain cylindrical members exposing a portion of said current carrier;

a second electrical extension termination port formed within said conductive surface of certain cylindrical members disposed opposite from said first electrical extension termination port;

an electrical extension element having a first transverse leg pivotally received by said first electrical extension termination port and a second transverse leg pivotally received by said second electrical extension termination port providing said extension element with a second rotational axis with respect to said certain cylindrical member;

said first transverse leg having a first end in electrical connection with said current carrier and a distill end for electrically carrying said first contact terminal of said illuminant;

said second transverse leg having a first end for contacting said conductive surface and a distill end for electrically carrying said second contact terminal of said illuminant;

whereby said illuminant is electrically carried by said plurality of cylindrical members and said extension element and maybe rotated about a first axis around said cylindrical member and around a second axis defined by the plane where said extension element is received by said certain of said cylindrical members.

2. The light assembly of claim 1 wherein said current carrier includes a first transverse leg channel formed within said current carrier for carrying said first transverse leg in electrical connection with said current carrier.

3. The light assembly of claim 2 wherein said first transverse leg channel includes threaded grooves, said first transverse leg carrying a first threaded pin for being received by said threaded first transverse leg channel for pivotally mounting said first transverse leg with said first transverse leg channel.

4. The light assembly of claim 3 wherein said second extension termination port includes threaded grooves, said second transverse leg of said electrical extension element carrying a second threaded pin, said second threaded pin being received by said threaded second termination port for pivotally mounting said second transverse leg with said second termination port.

5. The light assembly of 4 including a first and second insulation casing wrapped along a general length of said first and second threaded pins, said casings for abutting said surface of said cylindrical members for enabling said second threaded pin to be in contact with said conductive surface and said first threaded pin to be received within said first transverse leg channel.

6. The light assembly of claim 1 wherein a certain of said cylindrical members includes a first shoulder formed by said surface, said shoulder being received within an adjacent cylindrical member for defining said rotary joint.

7. The light assembly of claim 1 wherein a certain of said cylindrical member has an angle cut and an adjacent cylindrical member has a similar angle cut so that both members may fit together forming a right angle.

8. A low voltage lighting assembly powered by a low-voltage power supply providing an illuminant with various illumination positions, said illuminant having a first contact terminal and a second contact terminal, said lighting assembly comprising:

a. a lighting support member including:

(i) a first cylindrical lighting support element having a first conductive surface;

(ii) a first current carrier enclosed within said first cylindrical lighting support element for carrying an electrical current from said low-voltage power supply to said illuminant;

(iii) a first insulation layer for insulating said first current carrier from said first conductive surface of said first cylindrical lighting support element;

(iv) a first extension termination port formed within said first conductive surface and first insulation layer exposing a portion of said first current carrier;

(v) a second extension termination port formed within said first conductive surface disposed opposite from said first termination port;

(vi) a second cylindrical lighting support element having a second conductive surface;

(vii) a second current carrier enclosed within said second cylindrical lighting support element for carrying an electrical current from said low-voltage power supply to said illuminant, (viii) a second insulation layer for insulating said second current carrier from said second conductive surface of said second cylindrical lighting support element;

(ix) said second cylindrical lighting support element being matingly received in axial alignment by said first cylindrical lighting support element for contacting said first current carrier with said second current carrier and contacting said first conductive surface with said second conductive surface for carrying an electrical current from said low-voltage power supply to said illuminant;

(x) a rotary joint defined between said first and second cylindrical lighting support elements providing said first and second cylindrical lighting support elements with rotational movement with respect to each other around a central axis;

b. an illuminant extension member including:

(i) a first electrical circuit extension member having a first end and a distal end, said first end carried by said first extension termination port of said first cylindrical lighting support member for being electrically connected with said first current carrier;

(ii) a second electrical circuit extension member having a first end and a distal end, said first end carried by said second extension termination port of said first cylindrical lighting support member for being carried by said surface of said first cylindrical lighting support member;

c. an illuminant carrier including:

(i) a first illuminant carrier member having a first end and a second end, said first end being pivotally received by said distal end of said first electrical circuit extension member, said second end for receiving said first contact terminal of said illuminant;

a second illuminant carrier member having a first end and a second end, said first end being pivotally received by said distal end of said second electrical circuit extension member, said second end for receiving said second contact terminal of said illuminant;

said first and second illuminant carrier members being pivotable around said distal ends of said illuminant extension member for pivoting said illuminant around a second axis defined by the plane where said illuminant carrier is received by said illuminant extension member.

9. A light assembly of claim 8 wherein said second cylindrical lighting support element extends beyond said second current carrier defining a first current carrier receptacle for receiving said first current carrier, said first current carrier extending beyond the periphery of said first cylindrical lighting support element for being received within said first current carrier receptacle for contacting said second current carrier, and said first conductive surface of said first cylindrical lighting support element contacting said second conductive surface of said second cylindrical lighting support element when said first current carrier contacts said second current carrier.

10. The light assembly of claim 9 including a centered holder for attachment to said lighting support member for holding said light support member with a structure.

11. The light assembly of claim 10 wherein said lighting support member is set symmetrically to said illuminant.

12. The lighting assembly of claim 10 wherein said holder includes a third cylindrical lighting support element having a third conductive surface and a third current carrier, said lighting support member including a holder receptacle formed within a certain of said first or second cylindrical lighting support elements for receiving said third current carrier in electrical connection with either said first or second current carrier and said third conductive surface being in contact with either said first or second conductive surface.

13. A low-voltage lighting assembly powered by a low-voltage power supply providing an illuminant with various illumination positions, said illuminant having a first contact terminal and a second contact terminal, said light assembly comprising:

a plurality of cylindrical members joined end to end in axial alignment;

said cylindrical members having a conductive surface;

a current carrier enclosed within said cylindrical members for carrying an electrical current;

an insulation layer for insulating said current carrier from said conductive surface of said cylindrical members;

a rotary joint defined between adjacent cylindrical members providing said adjacent cylindrical members with rotational movement around a central axis;

a first electrical extension termination port formed within said conductive surface and said insulation layer of certain cylindrical members exposing a portion of said current carrier;

a second electrical extension termination port formed within said conductive surface of certain cylindrical members disposed opposite from said first electrical extension termination port;

an electrical extension element having a first transverse leg pivotally received by said first electrical extension termination port and a second transverse leg pivotally received by said second electrical extension termination port providing said extension element with a second rotational axis with respect to said certain cylindrical member;

said first transverse leg having a first end and distal end, said first end for being in electrical connection with said current carrier;

said second transverse leg having a first end and a distal end, said first end for contacting said conductive surface;

a first illuminant carrier member having a first end and a second end, said first end being pivotally received by said distal end of said first transverse leg, said second end for receiving said first contact terminal of said illuminant;

a second illuminant carrier member having a first end and a second end, said first end being pivotally received by said second end of said second transverse leg, said second end for receiving a second contact terminal of said illuminant;

said first and second illuminant carrier members being pivotable around said first and second transverse legs for rotating said illuminant around a third axis;

so that said illuminant may be variably positioned with respect to three separate axes.

* * * * *